US007118437B1

(12) United States Patent
Bradley et al.

(10) Patent No.: US 7,118,437 B1
(45) Date of Patent: Oct. 10, 2006

(54) FLOTATION COLLAR

(75) Inventors: Gary F. Bradley, Hendersonville, NC (US); Jason A. Smith, Penrose, NC (US); C. Leon Rhodes, Flat Rock, NC (US)

(73) Assignee: H. Koch & Sons Co., Inc., Anaheim, CA (US)

( * ) Notice: Subject to any disclaimer, the term of this patent is extended or adjusted under 35 U.S.C. 154(b) by 21 days.

(21) Appl. No.: 10/968,395

(22) Filed: Oct. 18, 2004

(51) Int. Cl.
*B63C 9/08* (2006.01)

(52) U.S. Cl. ..... 441/118

(58) Field of Classification Search ..... 441/118
See application file for complete search history.

(56) References Cited

U.S. PATENT DOCUMENTS 2,210,809 A * 8/1940 Gray ..... 441/123
2,742,654 A * 4/1956 Hurt ..... 441/118
4,060,867 A 12/1977 Miller
4,297,758 A 11/1981 Moran
4,685,890 A 8/1987 Edwards
4,865,573 A 9/1989 Switlik, Jr. et al.
5,494,469 A * 2/1996 Heath et al. ..... 441/118
5,692,933 A 12/1997 Bradley et al.
6,589,088 B1 7/2003 Maness
6,837,764 B1 * 1/2005 Bradley ..... 441/106

* cited by examiner

*Primary Examiner*—Stephen Avila
(74) *Attorney, Agent, or Firm*—Kenneth L. Green; Edgar W. Averill, Jr.

(57) ABSTRACT

A flotation collar includes an exterior cover and a bladder with two cells separated by a baffle. The exterior cover includes circumferential cover zippers which unzip if the bladder is inflated, and bottle access zippers to allow, for example, CO2 bottles to be removed and replaced. Each cell has a manual inflation valve stem for manual inflation, and an automatic inflation valve stem for automatic inflation by the bottles. The baffle forms a vertical separation in a neck portion of the bladder, and a diagonal separation in lower portions of the bladder. The vertical separation allow either cell to fill the neck portion of the bladder if the other cell is deflated, to adequately carry the wearer's head above water, and the diagonal separation allows either cell in the lower portions of the bladder to retain sufficient volume if the other cell is deflated, to provide auto-rotation of the wearer.

19 Claims, 9 Drawing Sheets

FLOTATION COLLAR

BACKGROUND OF THE INVENTION

The present invention relates to flotation collars and in particular to a flotation collar which ensures auto-rotation of a wearer, either conscious or unconscious, and that the head of the wearer is carried above the water Military requirements and specifications, and Federal regulations require the presence of life preservers on board ships and on aircraft for use in the event of a water crash, ditching, ejection, or other event over water or in water. Crew members and passengers who may be required to use such life preservers may further desire features to enhance the reliability, operation, and ease of use of life preservers. In some instances, life preservers may be positioned at various locations around a ship, and donned only for drills or actual emergencies. In other cases, for example in military aircraft flown over water, inflatable flotation collars are worn while operating an aircraft.

U.S. Pat. No. 1,385,581, U.S. Pat. No. 2,210,809, and U.S. Pat. No. 5,421,760 disclose flotation devices residing about a wearer's neck. The resulting buoyancy carries the wearer face forward in the water in a somewhat vertical position. Swimming while thus positioned, especially for long distances, is difficult and exhausting.

Newer flotation collars extend below the neck, and thus lift more of the wearer's torso. Many of these newer flotation collars also include at least two chambers to provide redundancy. Unfortunately, multiple chambers may result in unstable support if one of the air compartments (or cells) fails. U.S. Pat. No. 5,692,933 describes a flotation collar having two symmetric cells within a fabric shell, either of which cells is able to support a wearer. Unfortunately, the flotation collar described in the '933 patent is somewhat bulky, and may limit the wearer's motion. Such limiting is often undesirable, for example, for a pilot.

BRIEF SUMMARY OF THE INVENTION

The present invention addresses the above and other needs by providing a flotation collar including an exterior cover and a bladder with two cells separated by a baffle. The exterior cover includes circumferential cover zippers which unzip if the bladder is inflated, and bottle access zippers to allow, for example, $CO_2$ bottles to be removed and replaced without otherwise opening the exterior cover. Each cell has a manual inflation valve stem for manual inflation, and an automatic inflation valve stem for automatic inflation by the bottles. The baffle forms a vertical separation in a neck portion of the bladder, and a diagonal separation in lower portions of the bladder. The vertical separation allows either cell to fill the neck portion of the bladder to adequately carry the wearer's head above water, and the diagonal separation and bladder shape allows either cell in the bladder lower portions to retain a shape and volume (i.e., buoyancy) if the other cell is deflated, thereby retaining an auto-rotation of the wearer feature and providing a layback angle for the wearer.

In accordance with one aspect of the invention, there is provided a flotation collar comprising an exterior cover and a bladder residing in the exterior cover. The bladder comprises a neck portion, a right lower portion below the neck portion, and a left lower portion below the neck portion. A first cell resides in the neck portion, the right lower portion and the left lower portion, and a second cell also resides in the neck portion, the right lower portion and the left lower portion. In the lower portions, the first cell substantially retains an intended inflated volume of the first cell if the second cell is not totally inflated, and the second cell substantially retains an intended inflated volume of the second cell if the first cell is not totally inflated, thereby retaining a roll-over feature and a layback feature if one cell deflates. In the neck portion, the first cell is expandable into substantially all of a first volume otherwise occupied by the second cell, if the second cell is deflated, and the second cell is expandable into substantially all of a second volume otherwise occupied by the first cell, if the first cell is deflated, thereby retaining the ability to carry the wearer with head above water.

In accordance with another aspect of the invention, there is provided a flotation collar comprising an exterior cover and a bladder. The bladder resides in the exterior cover and includes a neck portion, a right lower portion below the neck portion, a left lower portion below the neck portion, a first cell residing in the neck portion, the right portion and the left portion, a second cell residing in the neck portion, the right portion and the left portion, and a baffle partitions an interior of the bladder into the first cell and the second cell. In the neck portion, the baffle divides the bladder into two substantially equal halves and the baffle width is approximately equal to one half of the circumference of the bladder. In the lower portions the first cell is approximately fifty percent bounded by the bladder back, approximately twenty five percent bounded by the baffle, and approximately twenty five percent bounded by the bladder front, and the second cell is approximately fifty percent bounded by the bladder front, approximately twenty five percent bounded by the baffle, and approximately twenty five percent bounded by the bladder rear.

In accordance with yet another aspect of the invention, there is provided a flotation collar with a pair of circumferential cover zippers. The cover zippers meet at a top of the exterior cover, and continue down sides of the exterior cover, across bottoms of the exterior cover, and partially upward on inner edges of the exterior cover. The cover zippers are adapted to open from the top of the exterior cover if the bladder is inflated. A closure flap resides over the cover zippers on the top of the exterior cover to prevent accidental un-zipping of the cover zippers.

In accordance with a further aspect of the invention, there is provided a flotation collar with a pair of bottle access zippers in the exterior cover, the bottle zippers allow access to the bottles to remove and replace the bottles. Flotation vests have not been allowed to be packed in airline luggage because of the presence of $CO_2$ bottles or the like. The ability to easily remove and replace the bottles without otherwise opening the exterior cover, allows the flotation collars to be checked with luggage, and simplifies transporting them.

In accordance with another aspect of the invention, there is provided a flotation collar including a bladder attached to the exterior cover by three attachments inside the exterior cover. One attachment is in the neck portion and two attachments are in the lower portions. Placing attachments inside the exterior cover prevents the attachments from accidentally snagging on protruding objects.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
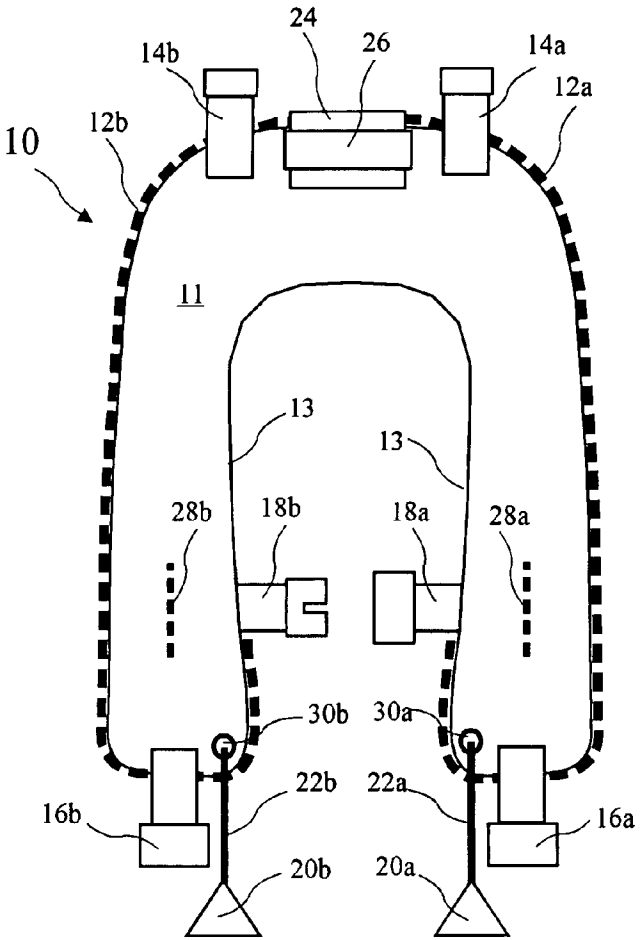
FIG. 1B is a rear view of the flotation collar according to the present invention.
Figure 1A:
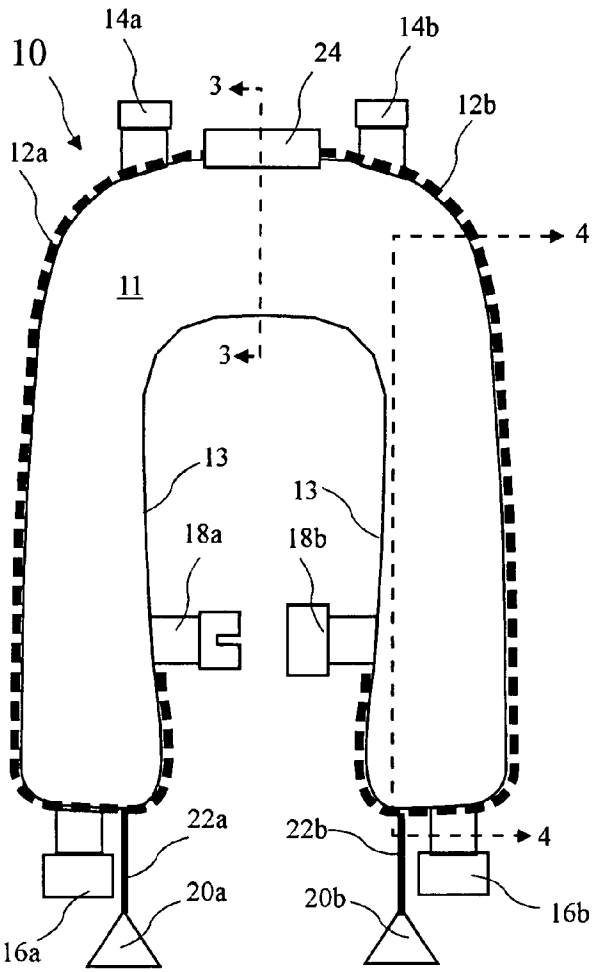
FIG. 1A is a front view of a flotation collar according to the present invention.

A front view of a flotation collar 10 according to the present invention is shown in FIG. 1A, and a rear (or wearing facing) view of the flotation collar 10 is shown in FIG. 1B. An exterior cover 11 covers the outer surface (front and rear) of the flotation collar 10. The exterior cover 11 is preferably made from a 2-ply nylon stiffener and nylon cloth. Circumferential cover zippers 12*a* and 12*b* meet at the top of the flotation collar 10, and continue down the sides, across the bottom, and partially upward on inner edges 13 of the flotation collar 10. Back connectors 14*a* and 14*b* are attached to an upper rear surface of the flotation collar 10, and allow the flotation collar 10 to be connected to a harness worn by a wearer. Front connectors 16*a* and 16*b* extend downward from a lower rear surface of the flotation collar 10 and also may be connected to the harness. Chest straps 18*a* and 18*b* extend inwardly from the inner edges 13. Actuator handles 20*a* and 20*b* are attached by actuator cords 22*a* and 22*b* to inflation apparatus (for example, valve and manifold 48 in FIG. 4), the cords 22*a*, 22*b* entering the flotation collar 10 through grommets (or reinforced areas) 30*a* and 30*b* respectively. A closure flap 24 resides over upper ends of cover zippers 12*a*, 12*b* to prevent accidental opening, and a flap retainer 26 holds the end of the closure flap 24. Other means, for example a velcro® fastener, may be used to the secure the closure flap 24. Bottle access zippers (or bottle zippers) 28*a* and 28*b* reside on the cover 11 to allow removal and replacement of bottles 44 (see FIG. 4). The zippers 28*a*, 28*b* are preferably approximately vertical.

Figure 1D:
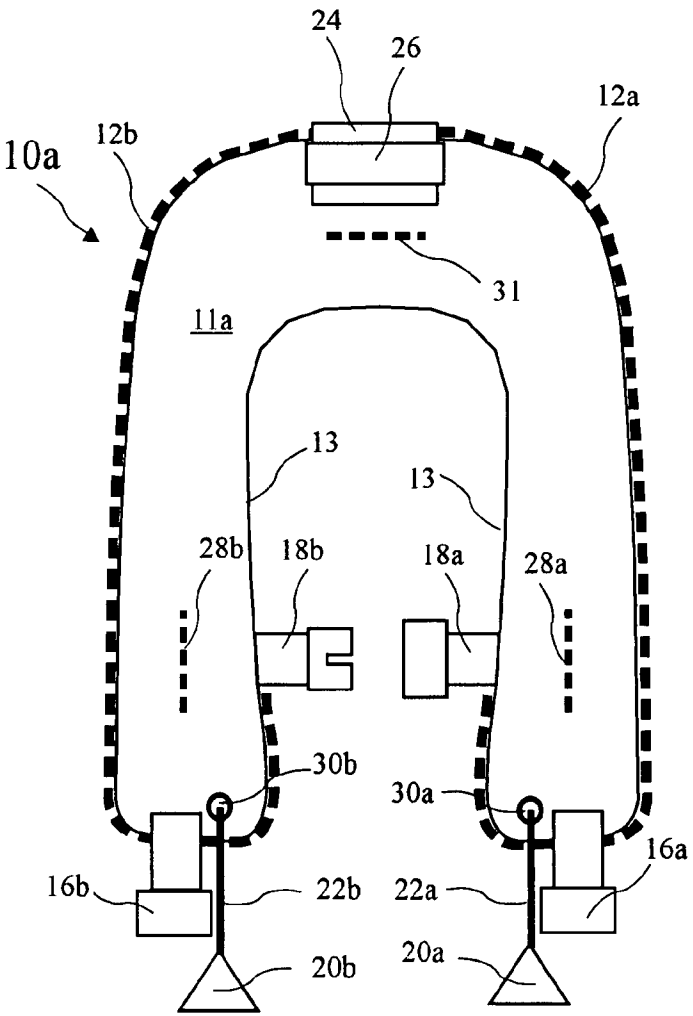
FIG. 1D is a rear view of the second flotation collar according to the present invention.
Figure 1C:
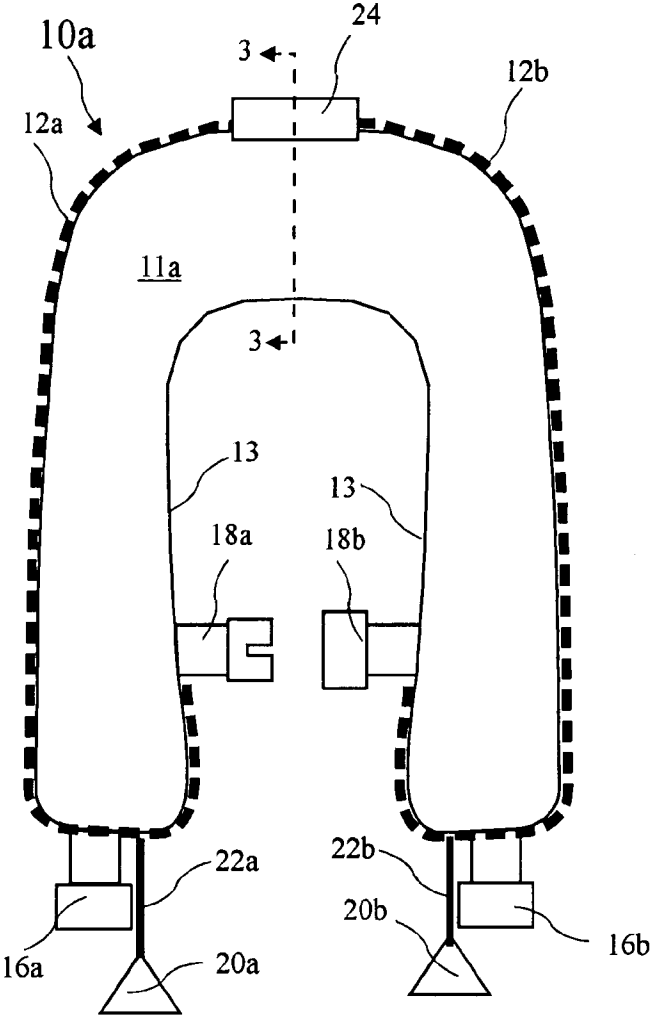
FIG. 1C is a front view of a second flotation collar according to the present invention.

A front view of a second flotation collar 10*a* according to the present invention is shown in FIG. 1C, and a rear view of the second flotation collar 10*a* is shown in FIG. 1D. The back of the flotation collar 10*a* includes a harness zipper 31 residing below the flap retainer 26. The zipper 31 is half of a zipper strip and may be zipped to a mating half attached to a harness, for example to an aircrew harness. The zipper 31 is preferably approximately 2.75 inches long.

Figure 1F:
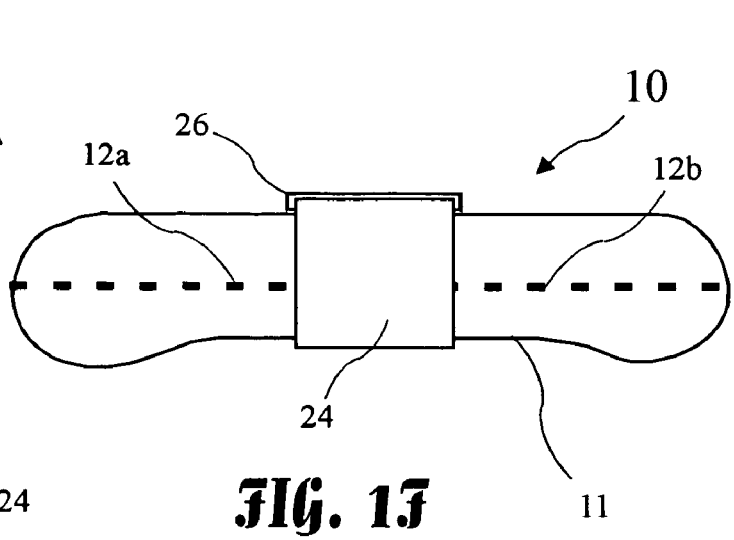
FIG. 1F is a top view of the flotation collar according to the present invention.
Figure 1E:
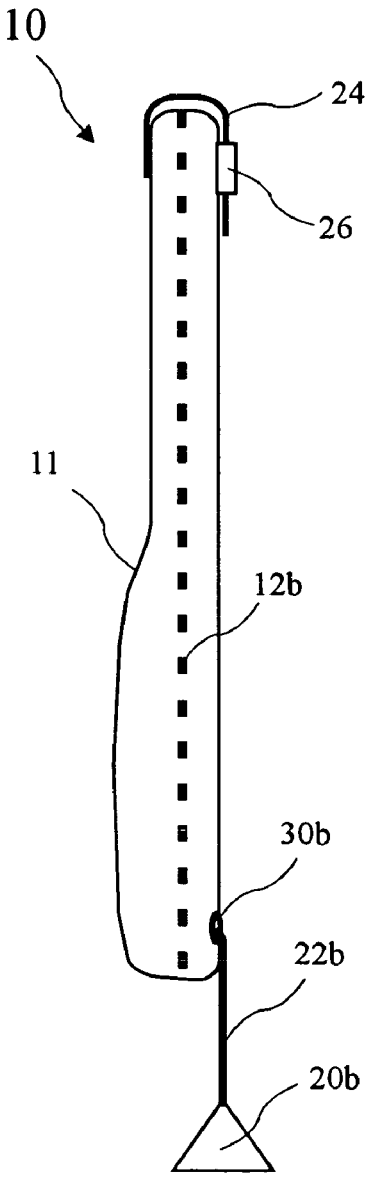
FIG. 1E is a side view of the flotation collar according to the present invention.

A side view of the flotation collar 10 is shown in FIG. 1E, and a top view in FIG. 1F. The cover zippers 12*a*, 12*b* are seen to run across the top of the flotation collar 10 and down the sides. The closure flap 24 is shown tucked into the flap retainer 26.

Figure 2A:
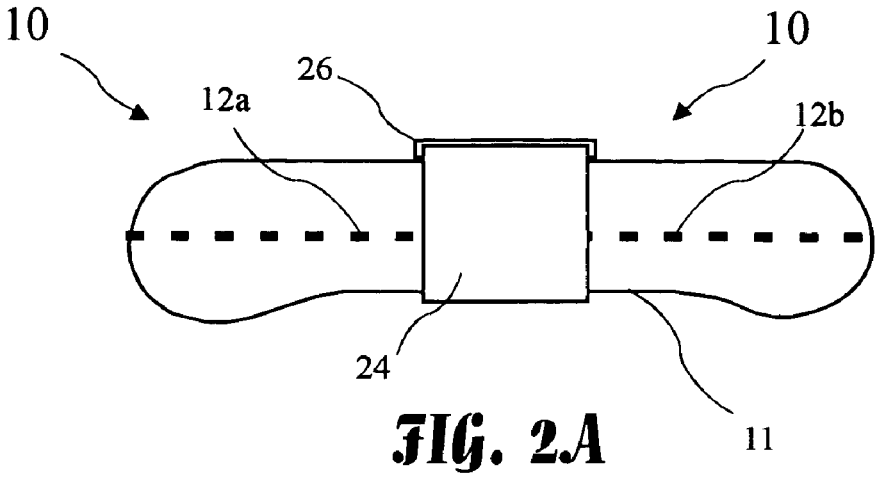
FIG. 2A is a top view of the flotation collar with a circumferential cover zipper covered by a closed closure flap.
Figure 2B:
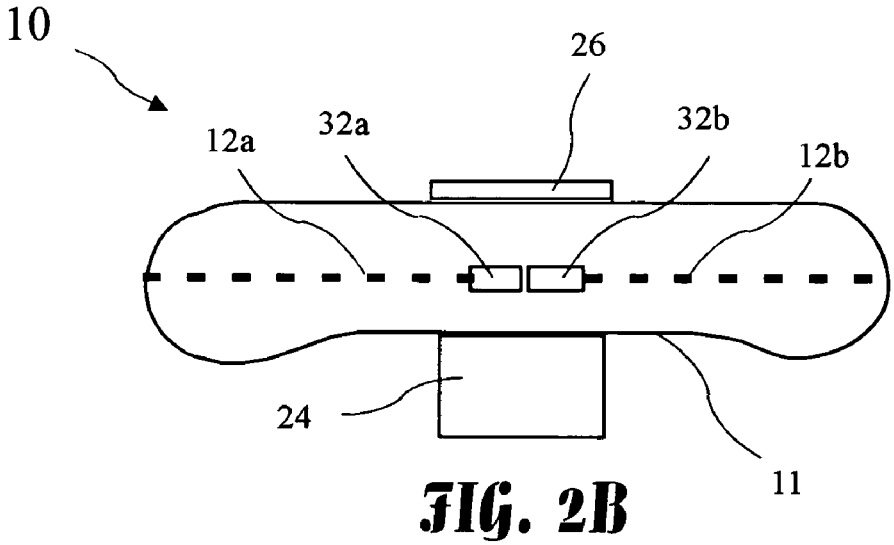
FIG. 2B is a top view of the flotation collar with the cover zipper exposed by an open closure flap.
Figure 2C:
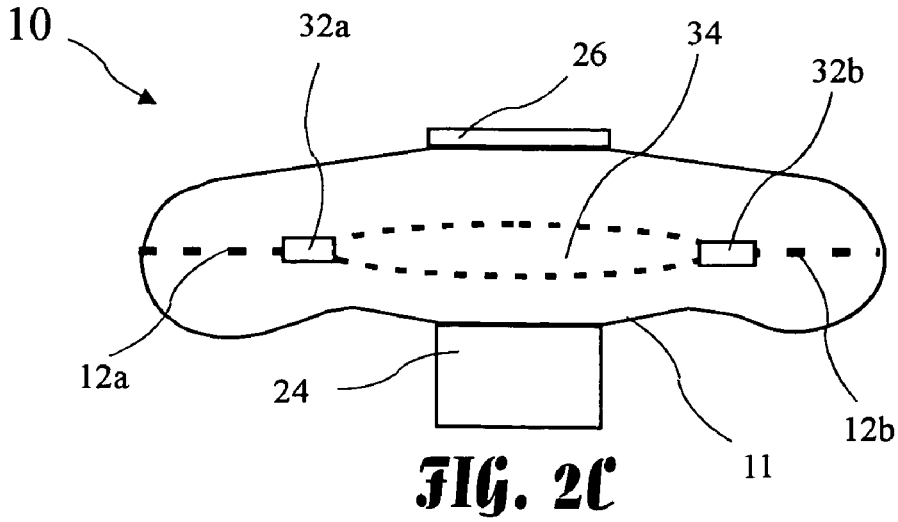
FIG. 2C is a top view of the flotation collar with the cover zipper partially open.

A sequence of top views of the flotation collar 10 are shown in FIGS. 2A through 2C. The cover zippers 12*a*, 12*b* are shown covered by a closed closure flap 24 in FIG. 2A. The cover zippers 12*a*, 12*b*, still in a zipped condition, are shown in FIG. 2B with the closure flap 24 opened (i.e., removed from the flap retainer 26), thereby exposing zipper pulls 32*a* and 32*b*. The cover zippers 12*a*, 12*b* may be manually opened or closed using the manual pulls 32*a*, 32*b*. The cover zippers 12*a*, 12*b* are shown partially open in FIG. 2C leaving a gap 34. The series of steps shown here may be initiated by pulling the actuator handles 20*a*, 20*b* (see FIGS. 1A, 1B). The actuator handles 20*a*, 20*b* are connected to the bottles 44, for example via the valve and manifold 48, and pulling the actuator handles 20*a*, 20*b* causes the bottles 44 to release gas into a bladder 60 (see FIG. 5). When the bladder 60 expands, the expansion causes the closure flap 24 to release, and the cover zippers 12*a*, 12*b* to unzip.

Figure 3:
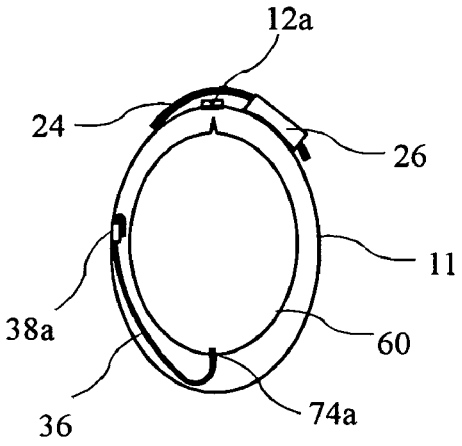
FIG. 3 is a cross-sectional view of the flotation collar taken along line 3—3 of FIG. 1A.
Figure 3A:
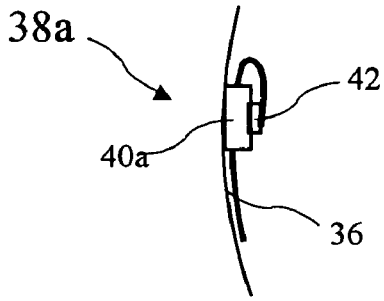
FIG. 3A is a detailed view of an attachment point for an upper attachment.

A cross-sectional view of the flotation collar 10 taken along line 3—3 of FIG. 1A, is shown in FIG. 3. An upper attachment strap 36 is attached to the bladder 60 at a bladder seam 74*a* (see FIG. 8A). The strap 36 attaches to an inside surface of the exterior cover 11. A detailed view of an upper attachment point 38*a* for the strap 36 is shown in FIG. 3A. The strap 36 loops through an upper loop 40*a*, and connects to a snap 42 on the surface of the loop 40*a*.

Figure 4A:
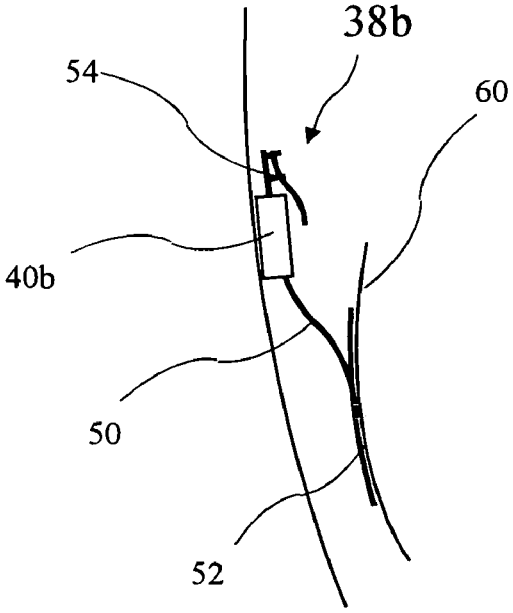
FIG. 4A is a detailed view of an attachment point for a lower attachment.
Figure 4:
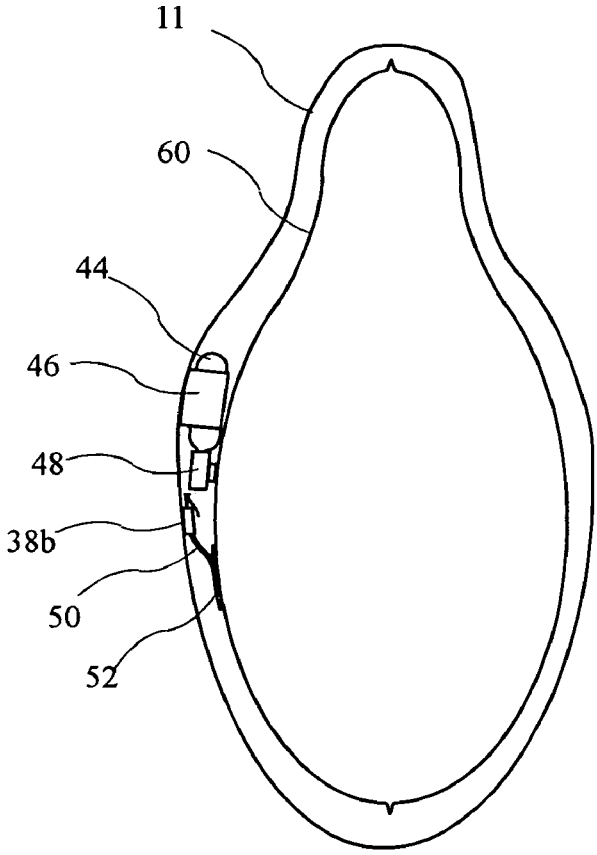
FIG. 4 is a cross-sectional view of the flotation collar taken along line 4—4 of FIG. 1A.

A cross-sectional view of the flotation collar 10 taken along line 4—4 of FIG. 1A, is shown in FIG. 4. The bottle 44 resides in a bottle housing 46 attached to the inner surface of the cover 11. The bottle housing 46 is preferably sewn to the cover 11. A valve and manifold 48 connect the bottle to the bladder 60. The actuator cord 22 connects to the valve and manifold 48 to allow automatic filling of the bladder 60. A lower attachment strap 50 is attached to an attachment patch 52 (also see FIG. 5) which is preferably sewn to the bladder 60. The strap 50 is connected to the cover 11 at attachment point 38*b*. A detailed view of an attachment point 38*b* is shown in FIG. 4A. The strap 50 passes through a lower loop 40*b*, and is retained by a clip 54. The clip 54 is preferably made from plastic. The attachment shown in FIGS. 4 and 4A, and the bottle 44, are similarly provided on each side of the flotation collar 10. The attachment straps 36 and 50 are sized and located to properly position the bladder 60 (when inflated) against the wearer such that intended performance is achieved, for example, auto rotation and layback angle.

Figure 5:
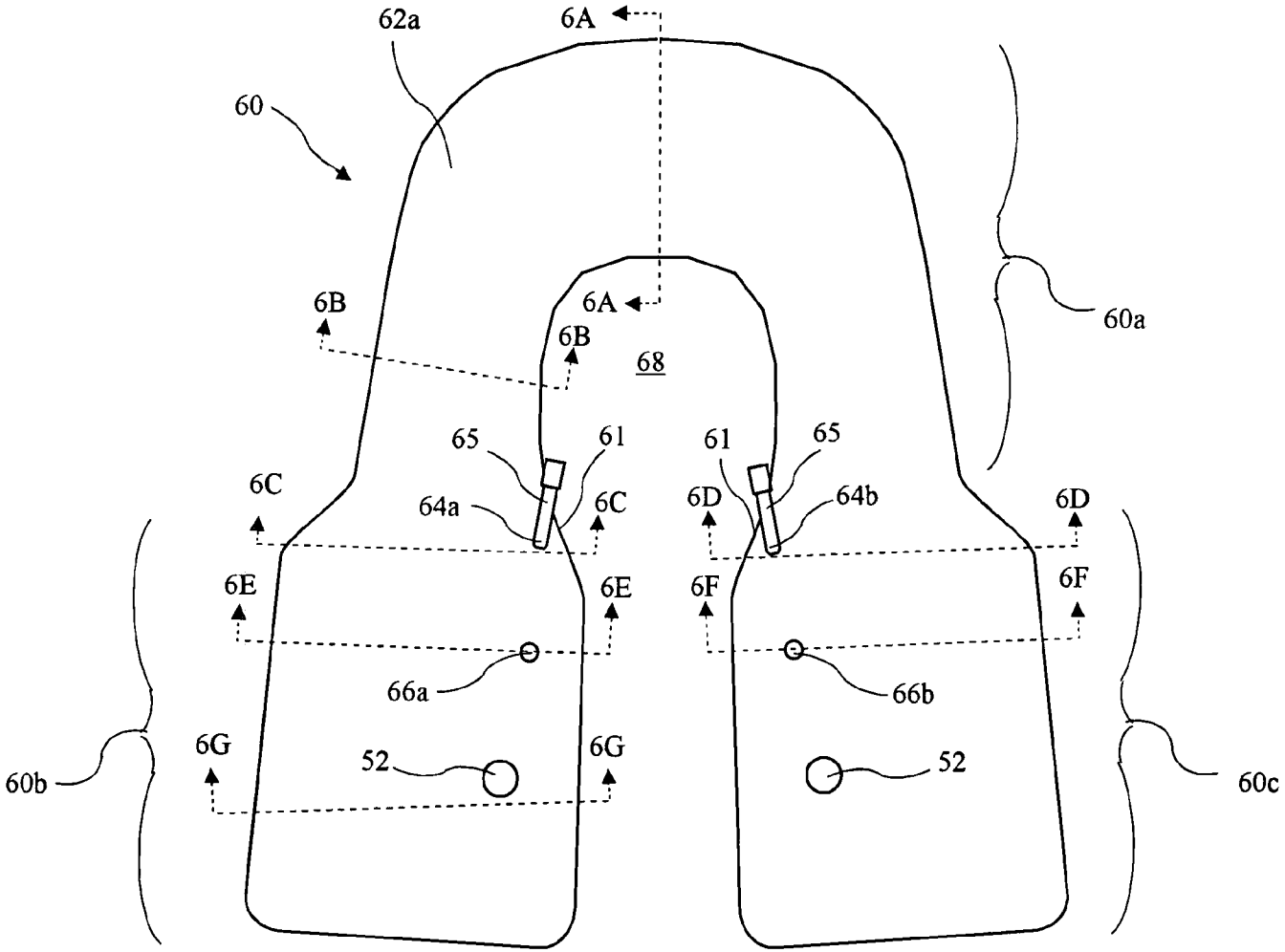
FIG. 5 is a rear (or side facing wearer) view of a bladder of the flotation collar according to the present invention.

A backside (or side facing the wearer) view of a bladder 60 for use in the flotation collar 10 according to the present invention is shown in FIG. 5. The bladder 60 includes a neck (or upper) portion 60*a*, a first (or left) lower portion 60*b*, and a second (or right) lower portion 60*c*. A bladder back 62*a* covers the entire back of the bladder 60, and a bladder front 62*b* (not shown) covers the entire front of the bladder 60 The neck portion 60*a* is approximately an upper half of the bladder 60, and the lower portions 60*b* and 60*c* are approximately lower halves of the bladder 60 Further, the neck portion 60*a* contains approximately twenty percent of the volume of the total combined volumes of the lower portions 60*b*, 60*c*.

Manual inflation valve stems 64*a* and 64*b* with mouth pieces 65 attached reside on the bladder back 62*a* near the transition between the neck portion 10*a* and the lower portions 10*b* and 10*c*. The valve stems 64*a* and 64*b* are positioned near a lower end of a neck opening 68 and near an inside edge 61 of the bladder 60. The mouth pieces 65 are preferably approximately three inches long, and allow manual filling or refilling of the flotation collar 10 while being worn. Automatic valve stems 66*a* and 66*b* reside on the bladder back 62*a*, and are adapted for automatic filling devices (e.g., $CO_2$ bottles 44) to fill the flotation collar 10. The automatic valve stems 66*a* and 66*b* are approximately below the valve stems 64*a* and 64*b*. The attachment patches 52 (also see FIGS. 4 and 4A) reside on the bladder back 62*a* below the automatic valve stems 66*a* and 66*b*.

The bladder back 62*a* and front 62*b* preferably provide an air tight compartment for the flotation collar 10, and the back and front 62*a* and 62*b* are preferably made from nylon cloth 200 Denier, coated, MIL-C-83489.

Figure 5A:
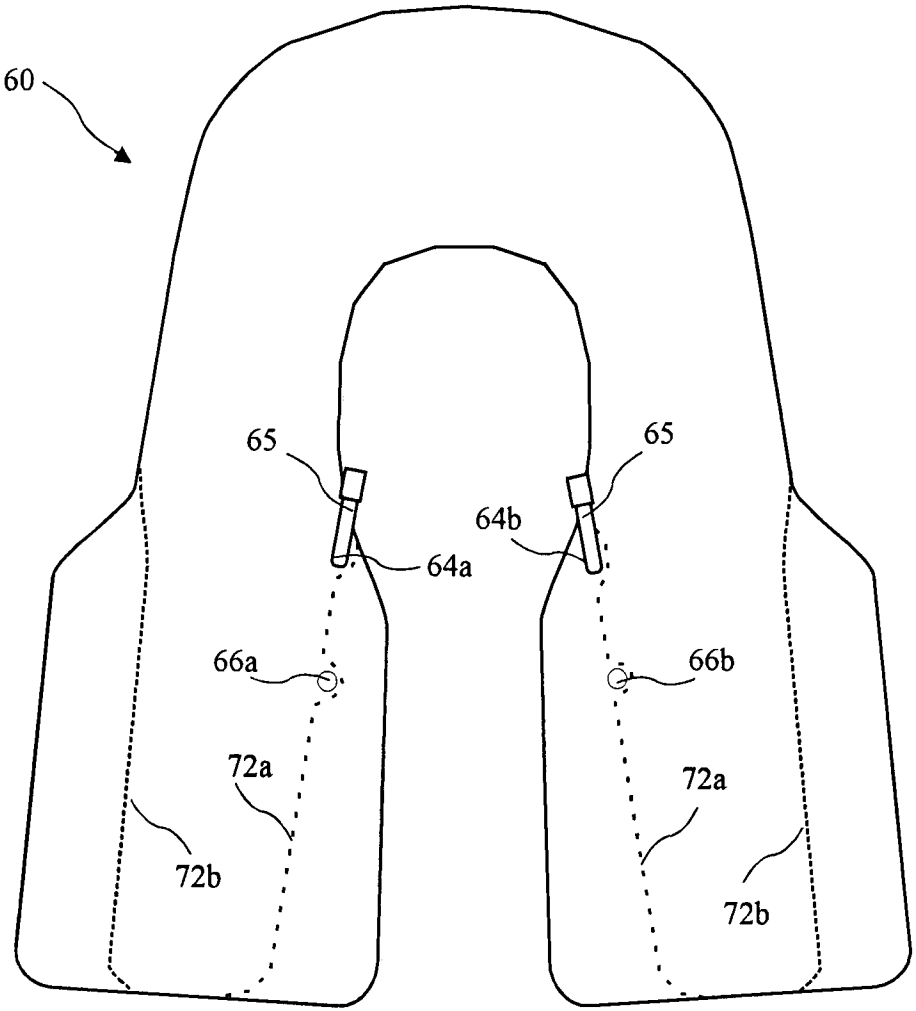
FIG. 5A is a rear (or side facing wearer) view of a bladder of the flotation collar showing contact lines between an interior baffle and the bladder.

A rear (or side facing wearer) view of the bladder 60 of the flotation collar 10 showing contact lines 72*a* and 72*b* between an interior baffle 72 (see FIGS. 6A through 6G) and an interior of the bladder 60 is shown in FIG. 5A. A rear (or side facing the wearing) contact line 72*a* is defined nearer to the center of the bladder 60 and shows the contact of the baffle 72 with the bladder rear 62*a*, and a front (or side away from the wearer) contact line 72*b* resides nearer to the outside of the bladder 60 and shows the contact of the baffle 72 with the bladder front 62*b*.

Figure 6A:
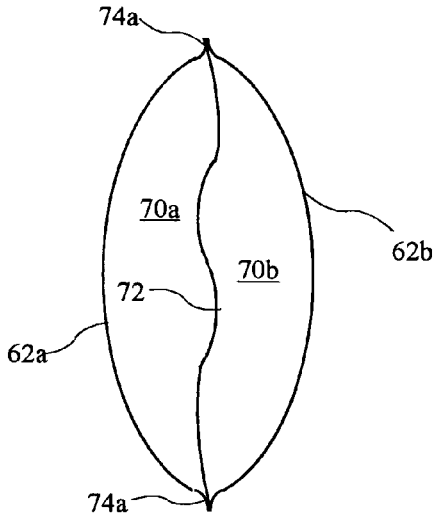
FIG. 6A is a cross-section of the flotation collar taken along line 6A—6A of FIG. 5.
Figure 6B:
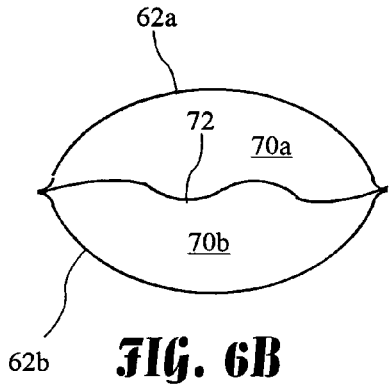
FIG. 6B is a cross-section of the flotation collar taken along line 6B—6B of FIG. 5.

A cross-section of the flotation collar 10 taken along line 6A—6A of FIG. 5 is shown in FIG. 6A. Line 6A—6A is a vertical cut taken approximately at the top of the neck portion 10*a* of the bladder 60. The baffle 72 separates a volume between the bladder back 62*a* and the bladder front 62*b* into a first cell 70*a* and a second cell 70*b*. The baffle 72 is preferably made from nylon cloth 200 Denier, double-coated, MIL-C-83489. The baffle 72 joins with the bladder back 62*a*, and bladder front 62*b* at edge seams 74*a*, and forms a substantially vertical separation between the cells 70*a*, 70*b*. A cross-section of the flotation collar taken along line 6B—6B of FIG. 5 is shown in FIG. 6B which is similar, but smaller than the cross-section at line 6A—6A.

Figure 6C:
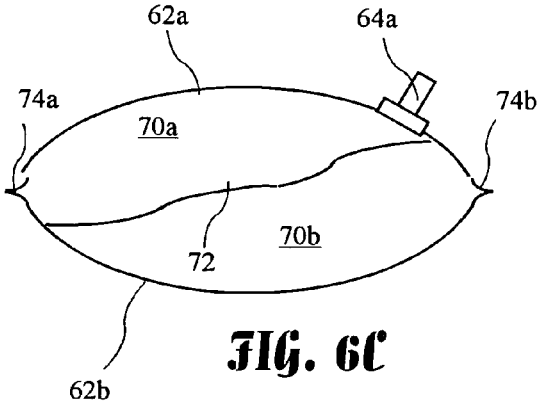
FIG. 6C is a cross-section of the flotation collar taken along line 6C—6C of FIG. 5.
Figure 6D:
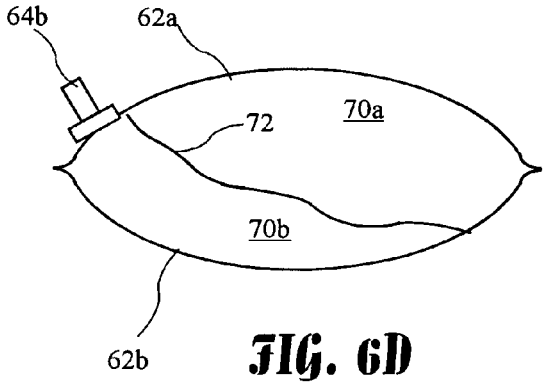
FIG. 6D is a cross-section of the flotation collar taken along line 6D—6D of FIG. 5.

A cross-section of the bladder 60 taken along line 6C—6C of FIG. 5 is shown in FIG. 6C. At line 6C—6C, the baffle 72 attaches to the bladder back 62*a* and the bladder front 62*b*, preferably near, but not at, the edge seams 74*a*. An inner end of the manual inflation valve 64*a* is in fluid communication with the first cell 70*a*, thus allowing the cell 70*a* to be manually filled or refilled. A cross-section of the flotation collar taken along line 6D—6D of FIG. 5 opposite the cross-section in FIG. 6C is shown in FIG. 6D. An inner end of the manual inflation valve 64*b* is in fluid communication with the second cell 70*b*, thus allowing the cell 70*b* to be manually filled or refilled.

Figure 6G:
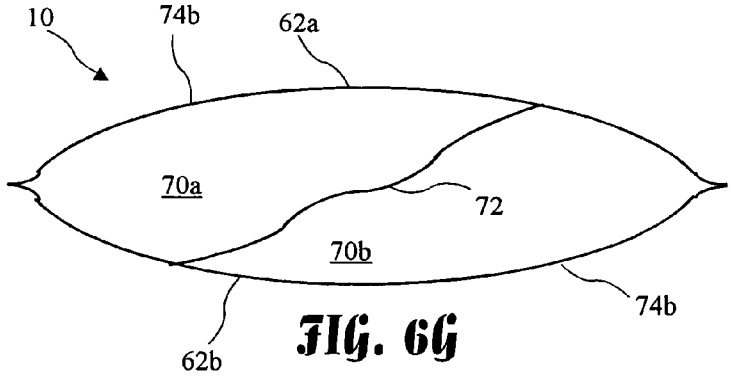
FIG. 6G is a cross-section of the flotation collar taken along line 6G—6G of FIG. 5.
Figure 6E:
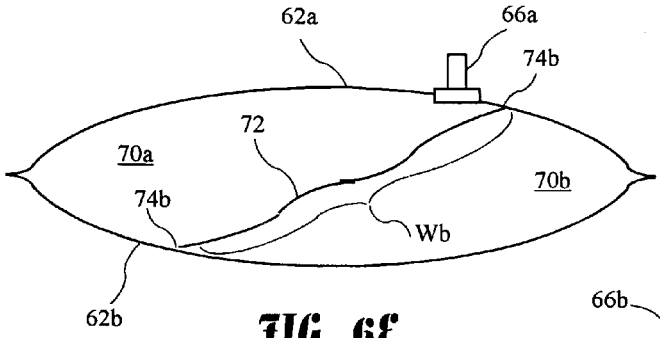
FIG. 6E is a cross-section of the flotation collar taken along line 6E—6E of FIG. 5.

A cross-section of the bladder 60 taken along line 6E—6E of FIG. 5 is shown in FIG. 6E. The automatic inflation valve 66*a* is shown in fluid communication with the cell 70*a*, thus allowing the cell 70*a* to be automatically filled. The width of the baffle Wb is approximately 4/10 the total width of the lower portion 60*b* at the line 6E—6E when laying flat, and is approximately centered laterally in the lower portion 60*b*. The baffle 72 is attached to the bladder back 62*a*, and front 62*b* at baffle seams 74*b* (see FIG. 8B for details), and assumes a diagonal to vertical position when the cells 70*a*, 70*b* are inflated. The cells 70*a*, 70*b* are individually constructed in the lower portions 60*b*, 60*c* to substantially retain their intended inflated volumes if only one cell is inflated. Thus, the cells 70*a*, 70*b* are constructed to allow the first cell 70*a* to substantially retain a first intended inflated volume of the first cell 70*a* if the second cell 70*b* is not totally inflated, and to allow the second cell 70*b* to substantially retain a second intended inflated volume of the second cell 70*b* if the first cell 70*a* is not totally inflated, thereby retaining a roll-over feature if one cell deflates and providing a layback angle for the wearer.

For example, if one cell 70*a* or 70*b* deflates, a portion of the gas in the cell remaining inflated may flow from the lower portions 60*b* and 60*c* to the neck portion 60*a*. The volumes of the cells 70*a* and 70*b* in the lower portions 60*b* and 60*c* relative to the neck portion 60*a* are established so that even if the cell remaining inflated fills the entire neck portion 60*a*, sufficient gas will remain in the lower portions 60*b* and 60*c* to retain the roll-over feature of the flotation collar 10. Preferably, the neck portion 60*a* contains approximately twenty percent of a combined volume of the lower portions 60*b* and 60*c*, thereby limiting the amount of air which may flow from the lower portions 60*b* and 60*c* of the bladder 60 into the neck portion 60*a* of the bladder 60, and thus ensuring that enough air remains in the lower portions 60*b* and 60*c* for retention of the roll-over feature.

Figure 6F:
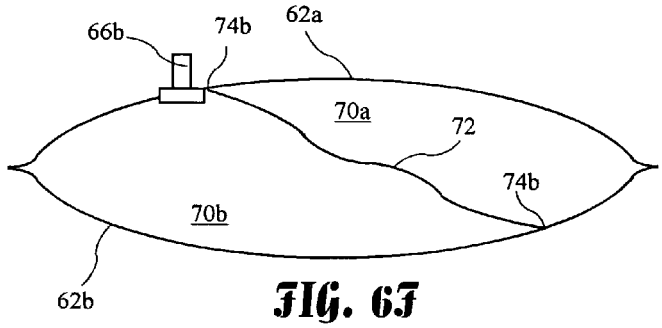
FIG. 6F is a cross-section of the flotation collar taken along line 6F—6F of FIG. 5.

A cross-section of the bladder 60 taken along line 6F—6F of FIG. 5 opposite the cross-section in FIG. 6E is shown in FIG. 6F. An inner end of the automatic inflation valve 66*b* is in fluid communication with the second cell 70*b*, thus allowing the cell 70*b* to be automatically filled.

A cross-section of the bladder 60 taken along line 6G—6G of FIG. 5 is shown in FIG. 6G. Other than the absence of valves, the cross-section of FIG. 6G is approximately the same as the cross-section of FIG. 6E.

As seen in FIGS. 6A–6G, the cells 70*a*, 70*b* are substantially (i.e., other than to accommodate the valves 64*a*, 64*b*,

66*a*, and 66*b*) bi-laterally (i.e., left, right) symmetric. Further, in the lower portions 60*b* and 60*c* the first cell 70*a* is approximately fifty percent bounded by the bladder back 62*a*, twenty five percent bounded by the baffle 72, and twenty five percent bounded by the bladder front 62*b*, and the second cell 70*b* is approximately fifty percent bounded by the bladder front 62*b*, twenty five percent bounded by the baffle 72, and twenty five percent bounded by the bladder rear 62*a*.

In summary, the size and shape of the baffle 72, and cooperation of the baffle 72 with the bladder 60, controls the change in volume and pressure within the inflated cell 70*a* or 70*b* should the other cell 70*a* or 70*b* deflate. The baffle 72 is made smaller in the lower portions 60*b* and 60*c* relative to the bladder 60, to limit the volume change in the inflated cell when the other cell deflates, thereby retaining an intended shape and buoyancy. The baffle 72 is made wider in the neck portion 60*a* relative to the bladder 60 so that a still inflated cell can expand into the volume otherwise occupied by a deflated cell, to adequately carry a wearer's head above water.

Figure 7:
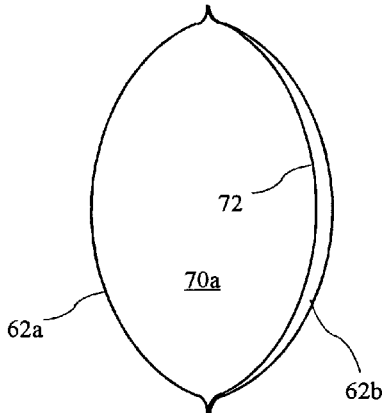
FIG. 7 is a second cross-section of the flotation collar taken along line 6A—6A of FIG. 5 with a second cell deflated and a first cell substantially filling a neck portion of the flotation collar.

A second cross-section of the bladder 60 taken along line 6A—6A of FIG. 5 is shown in FIG. 7 with a second cell 70*b* deflated and a first cell 70*a* substantially (e.g., other than small irregularities) filling the neck portion 60*a* of the bladder 60. The baffle 72 is seen to substantially lay against the bladder front 62*b*, wherein the cell 70*a* may expand to fill the volume previously occupied by the cell 70*b*. Thus, the baffle 72 is positioned in the neck portion 60*a*, and has sufficient extent, to allow the first cell 70*a* to expand into at least a portion of the area normally occupied by the second cell 70*b* if the second cell 70*b* is not totally inflated, and to allow the second cell 70*b* to expand into at least a portion of the area normally occupied by the first cell 70*a* if the first cell 70*a* is not totally inflated.

The ability to substantially fill the neck portion 60*a* even when one of the cells 70*a* or 70*b* is deflated, provides good support for the head of a wearer. The normal pressure in the cells 70*a*, 70*b* when both cells are fully inflated is preferably approximately three Pound per Square Inch (PSI), and the pressure in either cell 70*a* or 70*b* when the other cell is deflated is preferably approximately one PSI. The width of the baffle 72 in the neck portion 60*a* is about one half the circumference of the bladder 60 in the neck portion, thus allowing one cell 70*a* or 70*b* to substantially fill the entire neck portion 60*a*. Because of the relative volumes of the neck portion 60*a* compared to the lower portions 60*b* and 60*c*, the remaining inflated cell may substantially fill the entire neck portion 60*a* of the bladder 60, without substantially reducing the volume of the remaining inflated cell in the lower portions 60*b* and 60*c*.

Preferably, approximately ninety percent of the air contained in the portion of the first cell 70*a* residing in the lower portions 60*b*, 60*c* remains in the lower portions 60*b*, 60*c* if the second cell 70*b* is deflated, and preferably approximately ninety percent of the air contained in the portion of the second cell 13*b* residing in the lower portions 60*b*, 60*c* remains in the lower portions 60*b*, 60*c* if the first cell 70*a* is deflated.

The flotation collar 10 may (in the absence of external factors, e.g., laying on an irregular surface) preferably lay flat when the cells 70*a*, 70*b* are both deflated.

Figure 8A:
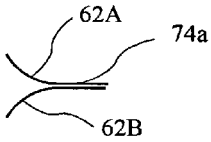
FIG. 8A is an edge seam of the flotation collar.
Figure 8B:
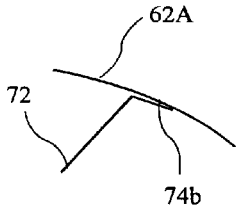
FIG. 8B is a baffle seam of the flotation collar.

A detailed view of the edge seam 74*a* of the bladder 60 is shown in FIG. 8A. The edge seam 74*a* is formed by radio frequency sealing. A detailed view of the baffle seam 74*b* of the bladder 60 is shown in FIG. 8B. The baffle seam 74*b* is preferably formed by radio frequency sealing.

While the invention herein disclosed has been described by means of specific embodiments and applications thereof, numerous modifications and variations could be made thereto by those skilled in the art without departing from the scope of the invention set forth in the claims.

We claim:

1. A flotation collar comprising:

an exterior cover; and a bladder residing in the exterior cover, the bladder comprising:

a neck portion;

a right lower portion below the neck portion;

a left lower portion below the neck portion;

a first cell residing in the neck portion, the right lower portion and the left lower portion;

a second cell residing in the neck portion, the right lower portion and the left lower portion; and a baffle partitioning an interior of the bladder into the first cell and the second cell, wherein in the neck portion the baffle partitions the bladder into two substantially equal halves, and a baffle width of the baffle in the neck portion is approximately equal to one half of the circumference of the bladder in the neck portion.

2. The flotation collar of claim 1, wherein in the neck portion:

the first cell is expandable into at least a portion of an area otherwise occupied by the second cell, if the second cell is not totally inflated; and the second cell is expandable into at least a portion of an area otherwise occupied by the first cell, if the first cell is not totally inflated, thereby retaining the ability to carry a wearer with head above water.

3. The flotation collar of claim 2, wherein in the neck portion:

the first cell is expandable into substantially all of the volume otherwise occupied by the second cell, if the second cell is deflated: and the second cell is expandable into substantially all of the volume otherwise occupied by the first cell, if the first cell is deflated, thereby retaining the ability to carry a wearer with head above water.

4. The flotation collar of claim 1, wherein the neck portion contains a neck volume which is approximately twenty percent of a combined volume of the lower portions.

5. The flotation collar of claim 1, wherein:

approximately ninety percent of the air contained in the portion of the first cell residing in the lower portions remains in the lower portions if the second cell is deflated; and approximately ninety percent of the air contained in the portion of the second cell residing in the lower portions remains in the lower portions if the first cell is deflated.

6. The flotation collar of claim 1, wherein:

the maximum pressure drop in the first cell is approximately two Pounds per Square Inch (PSI) if the second cell is deflated; and the maximum pressure drop in the second cell is approximately two PSI if the first cell is deflated.

7. The flotation collar of claim 1, wherein:

the bladder is formed by sealing a bladder front to a bladder rear along edges of the bladder front and the bladder rear; and in the neck portion, the baffle extends between the edges.

8. The flotation collar of claim 1, wherein;

the bladder is formed by sealing a bladder front to a bladder rear along edges of the bladder front and the bladder rear; and the baffle extends diagonally between the bladder front and the bladder rear in the lower portions.

9. The flotation collar of claim 1, wherein:

a baffle partitions an interior of the bladder into the first cell and the second cell; and in the right and left lower portions:

the first cell is approximately fifty percent bounded by the bladder back, approximately twenty five percent bounded by the baffle, and approximately twenty five percent bounded by the bladder front; and the second cell is approximately fifty percent bounded by the bladder front, approximately twenty five percent bounded by the baffle, and approximately twenty five percent bounded by the bladder rear.

10. The flotation collar of claim 1, wherein lower portions are approximately a lower half of the flotation collar.

11. The flotation collar of claim 1, wherein the bladder lays flat when the cells are deflated.

12. The flotation collar of claim 1, wherein the first cell is substantially laterally symmetric and the second cell is substantially laterally symmetric.

13. The flotation collar of claim 1, further including bottles for inflating the bladder, and bottle access zippers in the exterior cover adapted to allow access to the bottles to remove and replace the bottles.

14. The flotation collar of claim 1, further including cover zippers meeting at a top of the exterior cover, and continuing down sides of the exterior cover, across bottoms of the exterior cover, and partially upward on inner edges of the exterior cover, wherein the cover zippers are adapted to open from the top of the exterior cover if the bladder is inflated.

15. The flotation collar of claim 14, further including a closure flap over the cover zippers on the top of the exterior cover.

16. The flotation collar of claim 1, wherein the bladder is attached to the exterior cover by at least one attachment inside the exterior cover.

17. The flotation collar of claim 16, wherein the bladder is attached to the exterior cover by three attachments inside the exterior cover, wherein one attachment is in the neck portion, and two attachments are in the lower portions.

18. A flotation collar comprising:

an exterior cover; and a bladder residing in the exterior cover, the bladder comprising:

a neck portion;

a right lower portion below the neck portion;

a left lower portion below the neck portion;

a first cell residing in the neck portion, the right lower portion and the left lower portion; and a second cell residing in the neck portion, the right lower portion and the left lower portion, wherein:

in the lower portions, the first cell substantially retains a first intended inflated volume of the first cell if the second cell is not totally inflated, and the second cell substantially retains a second intended inflated volume of the second cell if the first cell is not totally inflated, thereby retaining a roll-over feature if one cell deflates; and in the neck portion, the first cell is expandable into substantially all of a first volume otherwise occupied by the second cell, if the second cell is deflated, and the second cell is expandable into substantially all of a second volume otherwise occupied by the first cell, if the first cell is deflated, thereby retaining the ability to carry a wearer with head above water and providing a layback angle for the wearer.

19. A flotation collar comprising:

an exterior cover; and a bladder residing in the exterior cover, the bladder comprising:

a neck portion;

a right lower portion below the neck portion;

a left lower portion below the neck portion;

a first cell residing in the neck portion, the right lower portion and the left lower portion;

a second cell residing in the neck portion, the right lower portion and the left lower portion, and a baffle partitioning an interior of the bladder into the first cell and the second cell, wherein:

in the neck portion, the baffle divides the bladder into two substantially equal halves, and the baffle width in the neck portion is approximately equal to one half of the circumference of the bladder in the neck portion; and in the lower portions:

the first cell is approximately fifty percent bounded by the bladder back, approximately twenty five percent bounded by the baffle, and approximately twenty five percent bounded by the bladder front; and the second cell is approximately fifty percent bounded by the bladder front, approximately twenty five percent bounded by the baffle, and approximately twenty five percent bounded by the bladder rear.

* * * * *